United States Patent [19]

Campanini

[11] Patent Number: 4,787,488

[45] Date of Patent: Nov. 29, 1988

[54] EXPANDABLE PIECE OF LUGGAGE

[76] Inventor: Giorgio Campanini, Via Servais 50, Torino, Italy

[21] Appl. No.: 47,486

[22] Filed: May 11, 1987

[30] Foreign Application Priority Data

May 15, 1986 [IT] Italy ..... 53411/86[U]

[51] Int. Cl.[4] ..... A45C 5/06; A45C 7/00; A45C 13/10; A45C 13/26

[52] U.S. Cl. ..... 190/104; 190/15 R; 190/22; 190/108; 190/109; 190/115; 220/8; 220/22.1; 220/230

[58] Field of Search ..... 190/15 R, 21, 22, 103, 190/104, 105, 107, 108, 109, 115, 15 A; 383/2; 220/8, 22.1, 230, 22.2; 206/818

[56] References Cited

U.S. PATENT DOCUMENTS

| | | | |
|---|---|---|---|
| 40,348 | 10/1863 | Mayer | 190/22 |
| 249,092 | 11/1881 | Protzen | 190/103 |
| 440,278 | 11/1890 | Payntar | 190/105 |
| 892,125 | 6/1908 | Bourne | 190/104 |
| 1,341,099 | 5/1920 | Abramson | 190/103 |
| 1,344,408 | 6/1920 | King | 190/22 X |
| 1,573,721 | 2/1926 | Loeffler | 190/107 |
| 1,756,775 | 4/1930 | Winning | 190/22 |
| 2,087,951 | 7/1937 | Jarvis | 190/108 X |
| 2,508,305 | 5/1950 | Teetor | 206/818 X |
| 3,128,855 | 4/1964 | Hoffman et al. | 190/115 |

FOREIGN PATENT DOCUMENTS

| | | | |
|---|---|---|---|
| 10970 | of 1928 | Australia | 190/105 |
| 339368 | 7/1921 | Fed. Rep. of Germany | 190/22 |
| 631038 | 12/1927 | France | 190/109 |
| 946031 | 5/1949 | France | 190/103 |
| 2233010 | 1/1975 | France | 190/104 |
| 260373 | 11/1926 | United Kingdom | 190/105 |
| 316728 | 8/1929 | United Kingdom | 190/109 |
| 488435 | 7/1938 | United Kingdom | 220/8 |

*Primary Examiner*—Sue A. Weaver
*Attorney, Agent, or Firm*—Robbins & Laramie

[57] ABSTRACT

A piece of luggage is disclosed which consists of a case in the shape of a flat parallelepiped comprising two greater rigid lateral walls and a rigid quadrangular frame with an upper side provided with a curved handle, a base side and end sides. At least one of its lateral walls is movable, being provided with a rigid perimetral edge which slides telescopically within the frame. Displacement of this lateral wall occurs in a direction perpendicular to its plane between a retracted position in which it is located in the plane of the corresponding edge of the frame and a projecting position. The result is that the internal volume of the case is increased.

30 Claims, 4 Drawing Sheets

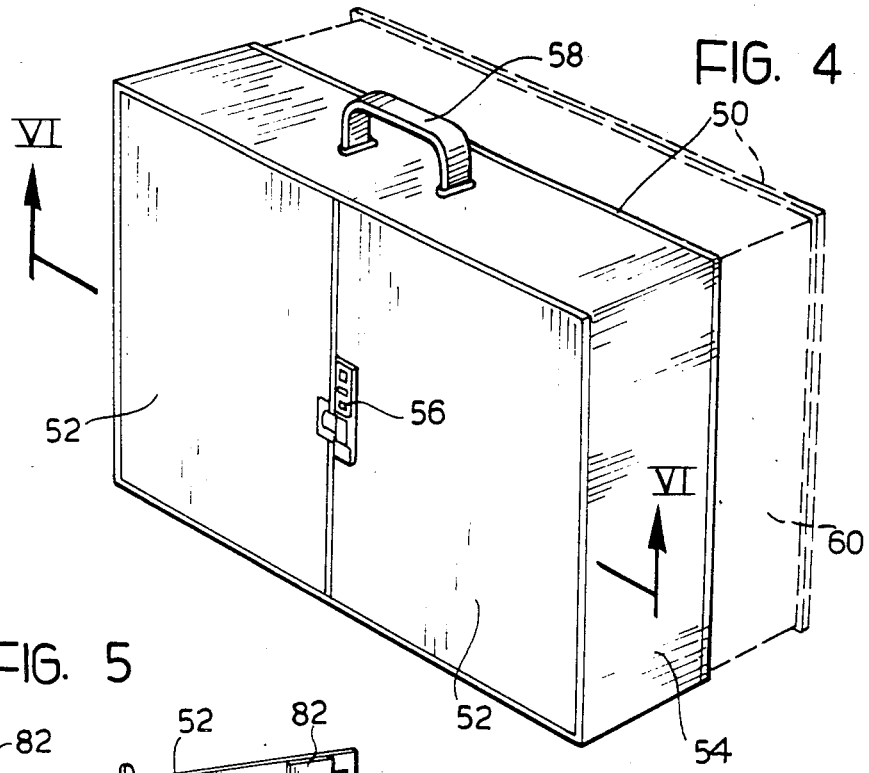
FIG. 4
FIG. 5
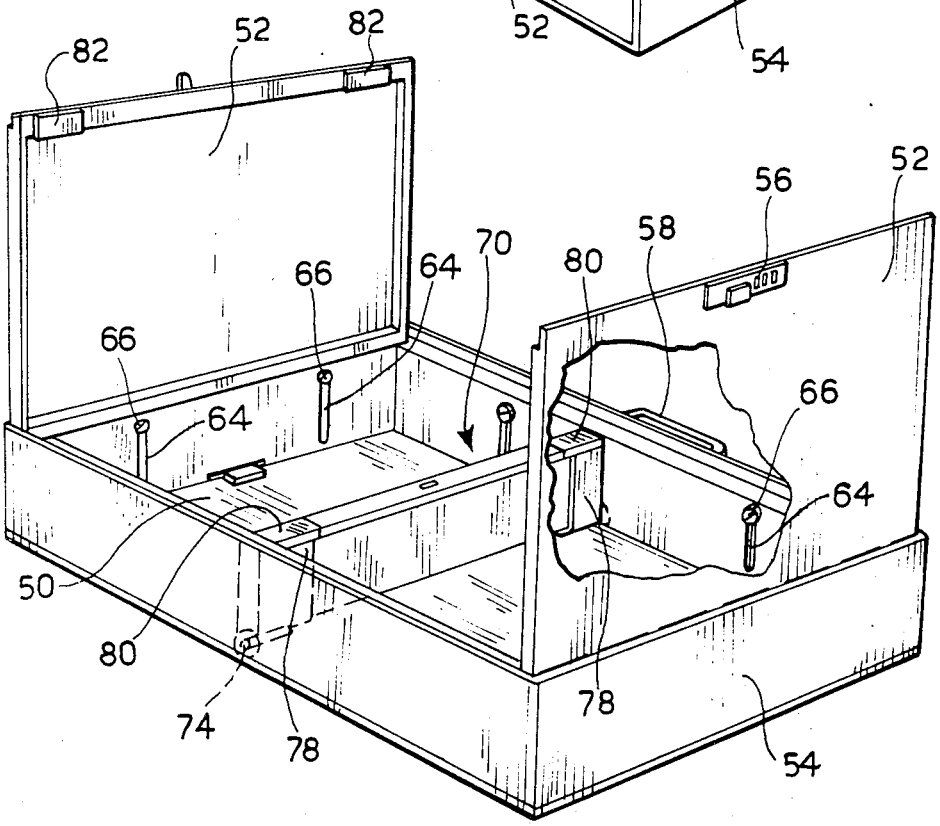

EXPANDABLE PIECE OF LUGGAGE

The present invention relates to a piece of luggage consisting of a case shaped as a flat parallel piped which comprises two greater rigid lateral walls and a rigid quadrangular frame with an upper side provided with a curved handle, a lower side and end sides.

Although the subject matter of the invention has been designed for use with overnight cases, it may also be applied to larger rigid suitcases.

A typical problem of an overnight case or a suitcase of small size will be examined below, although it is understood that this is not the only problem presented by these containers.

In many cases people make short business trips have to take both documents and personal effects. For convenience it is advantageous if the traveller can take a single small suitcase which may be accepted as hand baggage on an aeroplane. The traditional overnight case is ideal to take to a business meeting, but in this case it is better if it contains only documents and not personal effects. In addition, it is comparatively difficult to get one or more files and a similar number of personal effects, toilet requisites, etc. into an overnight case or a small suitcase.

The object of the present invention is to provide a piece of luggage which resolves these and other problems.

In accordance with the present invention, this object is achieved by a piece by luggage characterised in that at least one of its lateral walls is movable, being provided with a rigid perimetral edge which slides telescopically within the frame to allow the displacement of this lateral wall, in a direction perpendicular to its plane, between a retracted position in which it is located in the plane of the corresponding edge of the frame and a projecting position as a result of which the internal volume of the case is increased.

A solution of this type offers the following advantages among others. In the first instance, the entire transformable piece of luggage may also be used on a daily basis as a normal briefcase which is of attractive appearance as it is rigid. If the owner of the piece of luggage has to go on a trip and has to take personal effects with him, a sufficient amount of these may be packed in the piece of luggage together with any documents as a result of the volume increase which the movable lateral wall permits. If the owner of the case wants to look smart, for example at a bussiness meeting, he may unpack his personal effects beforehand, leaving them, for example, at a hotel, and attend the meeting with a flat case containing only the necessary documents.

Figure 2:
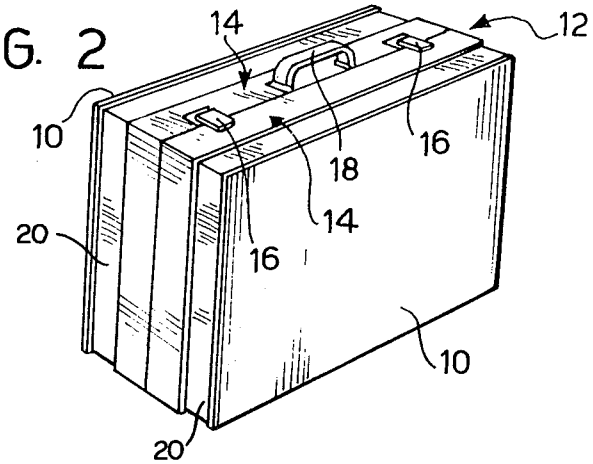
Figure 1:
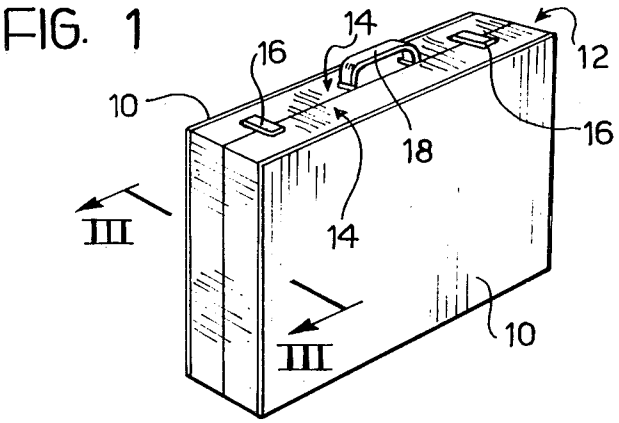
Figure 3:
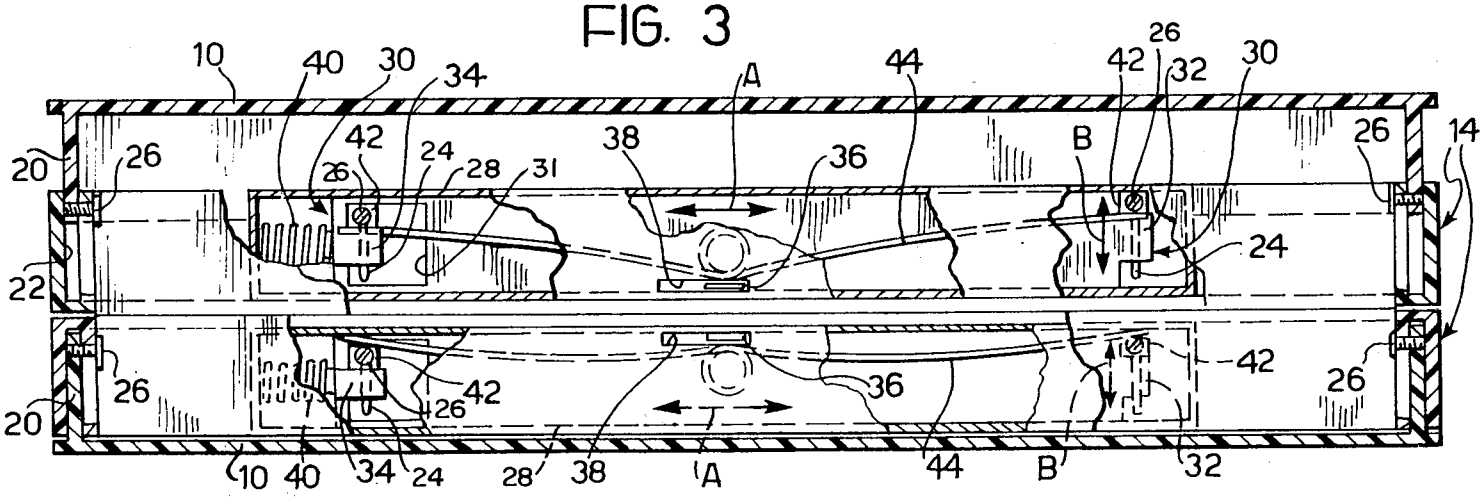
Figure 6:
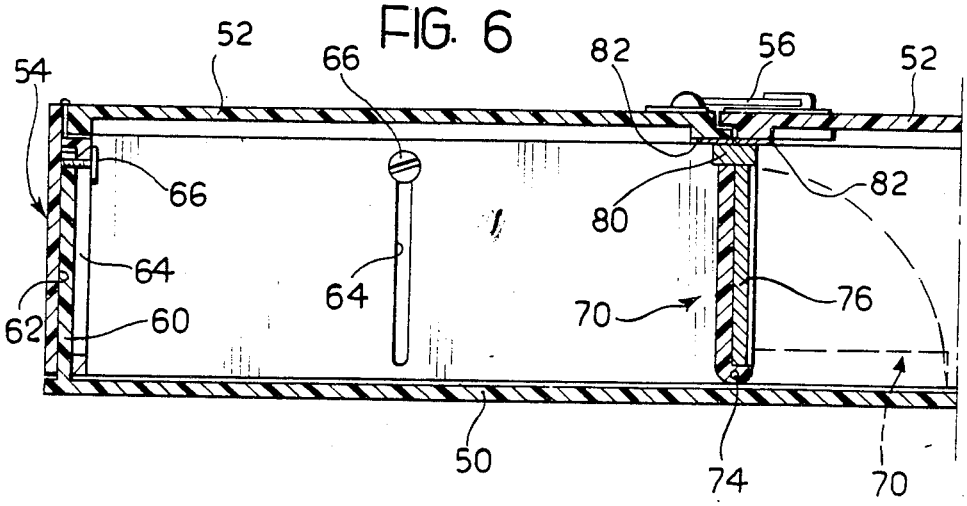
Figure 7:
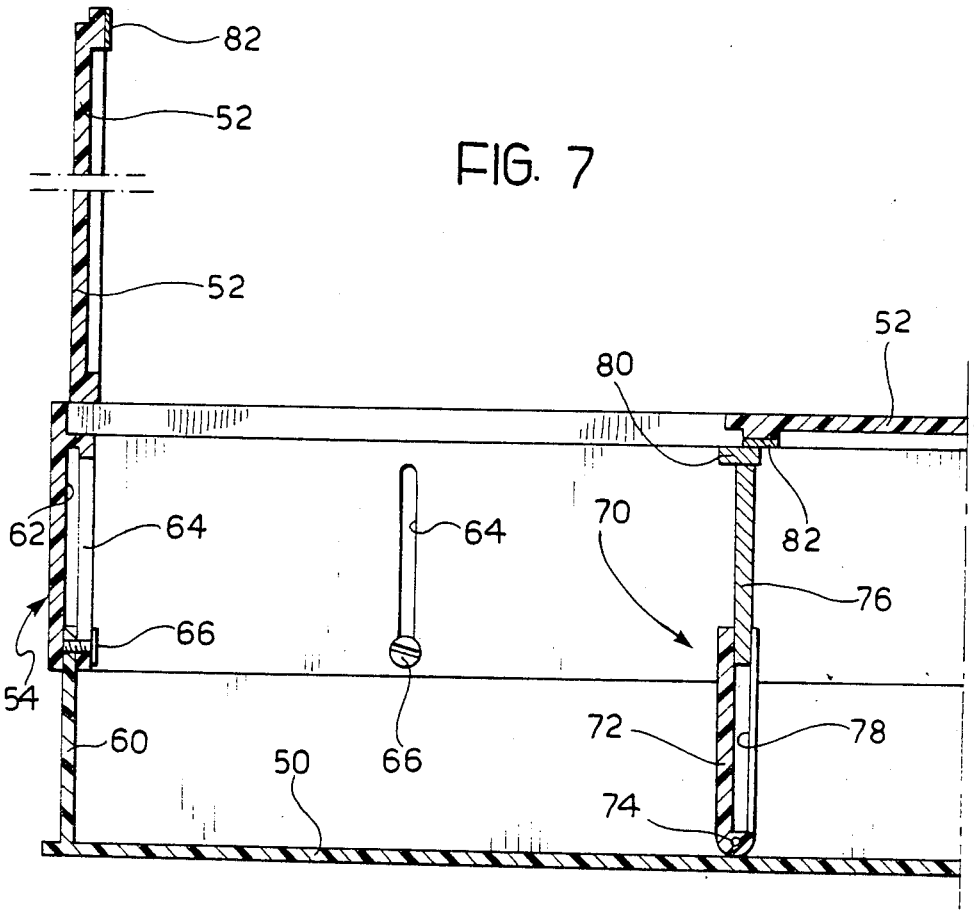
Figure 8:
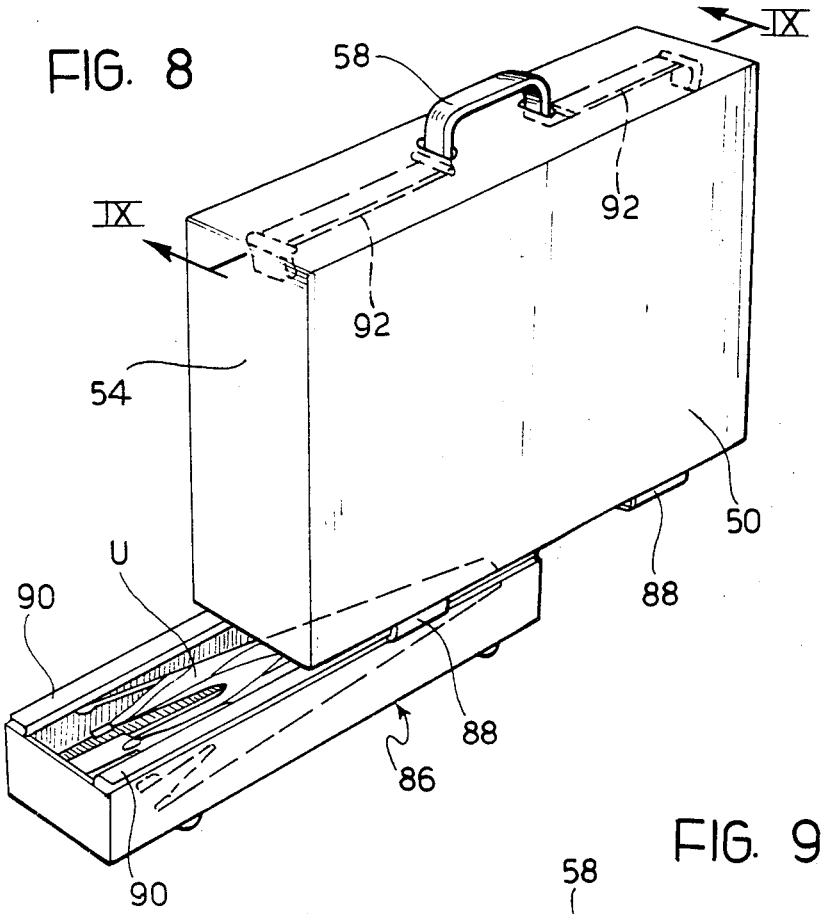
Figure 9:
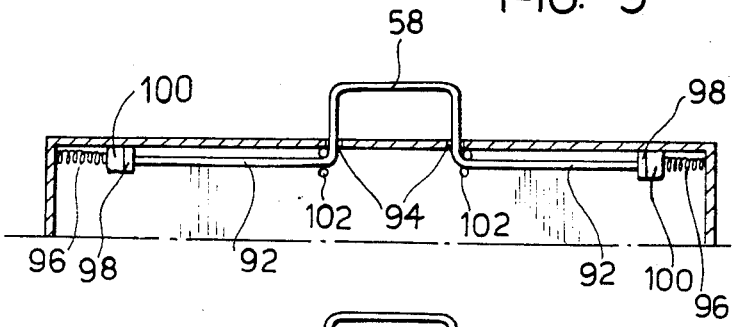
Figure 10:
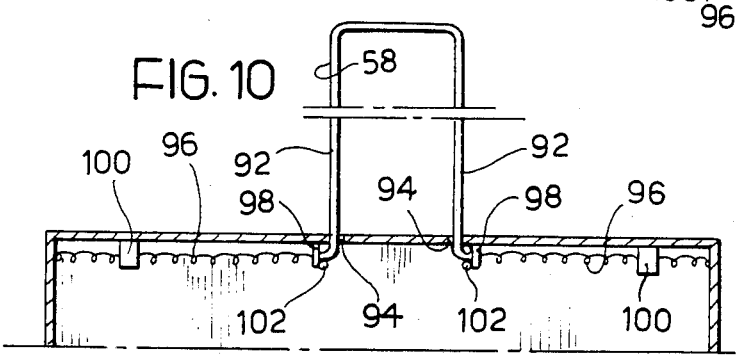

The above and other characteristic features and further advantages are described in the following detailed description, made with reference to the attached drawings, given by way of non-limiting example, in which:

FIG. 1 is a perspective view of a transformable piece of luggage of the invention, in the retracted position which makes it similar to a conventional overnight case, FIG. 2 is a perspective view of the piece of luggage of FIG. 1 in the fully extended position, FIG. 3 is a cross-section, with some components removed, along the line III—III of FIG. 1, with the piece of luggage retracted on one side and extended on the other, FIG. 4 is a perspective view of a further piece of luggage of the invention in a closed position, its configuration in the extended position also being shown in dashed lines, FIG. 5 is a perspective view of the piece of luggage of FIG. 4 in a completely open position, FIG. 6 is a horizontal section along the line of VI—VI of FIG. 4, FIG. 7 is a section corresponding to FIG. 6, where the piece of luggage is shown extended and half open, FIG. 8 is a further perspective view of the piece of luggage of FIG. 4 provided with a lower box, FIG. 9 is a partial vertical section along the line IX—IX of FIG. 8, FIG. 10 is a similar section to FIG. 9 showing the handle of the piece of luggage used as a shoulder strap.

With reference to FIG. 1, the piece of luggage consists in a case shaped as a flat parallelepiped. The case comprises two greater rigid lateral walls 10 and a rigid quadrangular frame 12. The frame 12 is divided along its median plane into two half-frames 14 which are hinged in a folding manner as is conventional for overnight cases.

The upper sides of the two half-frames 14 are provided with closures 16 of conventional type. The upper side of one of the half-frames 14 is also provided with a curved handle 18.

Reference will now be made to FIG. 2 to illustrate the features which make the piece of luggage of FIG. 1 transformable.

Each of the greater lateral walls 10 is provided with a respective rigid perimetral edge 20. This edge 20 is telescopically slidable within the respective half-frame 14.

As shown, each half-frame 14 is preferably cross-sectionally shaped as a narrow U, or as a double wall, so as to define a slot 22 into which the perimetral edge 20 is telescopically slidable. On all four sides of the inner wall of the frame 14 there are respective slits such as 24. Pins or screws 26, rigid with the respective edges 20 and which act as end stops for the extraction of the lateral walls 10, may slide in these slits.

By means of the structure illustrated in FIG. 3, each lateral wall 10 may be displaced, in a direction perpendicular to its plane, between the retracted position in FIG. 1, in which it is located in the plane of the corresponding edge of the half-frame 14, and the projecting position of FIG. 2. With one of the lateral walls 10 in the retracted position and the other lateral wall 10 in the projecting position, the internal volume of the piece of luggage is increased by just under one half times, while if both of the lateral walls 10 are in the projecting position the interval volume of the piece of luggage increased to slightly less than doubled the retracted volume.

The double-walled structure of the half-frames 14 is advantageously designed to ensure that the edges 20 of the lateral walls 10 do not interfere with the content of the case.

Means are preferably provided to keep each lateral wall 10 in both the retracted and projecting positions.

A preferred embodiment of these means is shown in FIG. 3.

A flat parallelepipedic box 28 is mounted in the slot 22 in the lateral walls of each half-frame 14, in which box a sheet metal cursor 30 slides in the direction of the double arrow A. One end of each cursor 30 (on the right-hand side of FIG. 3) has a projecting lug 32 and its other end (on the left-hand side of FIG. 3) a lug 34 bent into a U shape and is formed within the aperture 31 of the cursor.

In the central position each cursor 30 has an operating tongue 36 bent at right angles which projects into the case via a slot 38.

A compression spring 40 presses each cursor 30 into a locking position (on the right-hand side of FIG. 3).

Two slots, also designated by 24, each of which is respectively located in the vicinity of one end of the cursor 30, are provided in the innermost lateral walls of each half-frame 14. The edge 20 of each lateral wall 10 slides in a space between the box 28 and the outermost wall of the half-frame 14.

Respective screws, also designated by 26, which extend through respective stop blocks 42 and are screwed into the edge 20, are slidably mounted in the slots 24. The blocks 42 are located in the slot 24 and can slide, with the screws 26, along the slots 24 in the direction of the double arrows B.

Each box 28 contains (to the rear of the cursor 30 of FIG. 3) a "moustache" spring 44 which cooperates with the respective blocks 42 to press the respective lateral wall 10 into the projecting position as shown in the upper half of FIG. 3.

When one lateral wall 10 is in the retracted position, as in the lower half of FIG. 3, the lugs 32, 34 engage with the blocks 42 as a result of which the lateral wall is locked in the central position against the force of the spring 44.

In order to bring the lateral wall 10 into the projecting position, the user moves the corresponding tongue 36 (to the left of FIG. 3) with his finger and moves the cursor, against the force of its spring 40, into an unlocked position in which the lugs 32 and 34 are no longer engaged with the blocks 42. The "moustache" spring 44 then presses the blocks 42 until the lateral wall 10 is in the projecting position shown in the upper half of FIG. 3. The user then releases the tongue 36 and the spring 40 presses the cursor 30 into the original position, in which the lugs 32 and 34 lock blocks 42 as shown in the upper half of FIG. 3.

To retract the lateral wall the user displaces, as above, the cursor 30 into the locking position by means of the tongue 36, presses the lateral wall 10 against the force of the spring 44 to bring it into the retracted position and releases the tongue 36. The lateral wall 10 is then locked again into the position shown in the lower half of FIG. 3.

The various components of the piece of luggage of FIGS. 1 to 3 may be of any appropriate rigid material, such as plastics, light alloy, etc. As in the case of conventional overnight cases, it may be covered with leather, imitation leather, canvas or the like.

With reference now to FIG. 4 and following, the piece of luggage again consists of a case shaped as a flat parallelepiped, with one greater lateral wall 50 completely identical to the greater lateral walls 10 of the piece of luggage of FIGS. 1 to 3.

The other lateral wall is divided into two panels 52 hinged in the manner of the two doors of a cupboard. The frame 54, of rigid material, is continuous, i.e. it is not divided into two half-frames. The two panels 52 are hinged, in a manner which is not shown, to the corresponding edges of the two opposite end sides of the frame 54. The two panels 52 are provided, on their edges which meet, with a closure 56 to retain the piece of luggage in a closed position. The upper side of the frame 54 is provided with a curved handle 58.

As shown in FIGS. 6 and 7, the greater continuous rigid lateral wall 50 is provided with a rigid perimetral edge 60 which slides telescopically into the frame 54. As above, the frame 54 is preferably, in this case as well, cross-sectionally shaped as a narrow U or as a double wall to define a slot 62 in which the edge 60 of the wall 50 slides. In this case as well, the inner wall of the frame 54 has slots 64 in which screws or pins 66 rigid with the edge 60 can slide to act as end stops for the extraction of the wall 50.

As will be understood, the piece of luggage of FIGS. 4 and following may be transformed from the contracted or flat position, shown in continuous lines in FIG. 4, to the position in which its volume is slightly less than doubled by the extraction of the wall 50, as shown in dashed lines in FIG. 4 and as illustrated in FIG. 7.

Means (not shown), such as those shown in FIG. 3, are preferably associated with the lateral wall 50 to retain this wall 50 in both the retracted and the projecting positions.

With reference to FIGS. 5 to 7, the interior of the piece of luggage is divided into two sections by a partition shown overall by 70. The ideal size of the piece of luggage of FIGS. 4 and following is that in which the two sections bounded by the partition 70 each have a format slightly larger than that of conventional document folders. This size also makes it possible to pack one or more shirts folded in the normal way neatly into one of the sections.

It is preferable, as shown in detail in FIGS. 6 and 7, if the partition 70 can be retracted against the movable lateral wall 50, as shown in dashed lines in FIG. 6. This makes it possible to use the internal space of the piece of luggage for objects of larger size than each section.

The structure of the partition 70 shown, which is the preferred structure, comprises a bar 72 having a height equal to the spacing between the lateral walls 50 and 52 when the movable wall 50 is retracted. This bar 72 is hinged at 74 to the edge 60 of the wall 50 to allow its retraction as shown in FIG. 6. The bar 72 is associated with a further bar 76, which may slide into a position in which it is lowered into the area of the hinged bar 72 (FIG. 6) and a raised position (FIG. 7) in which the bar 76 occupies the space between the hinged bar 72 and the closed panels 52, when the wall 60 is in the projecting position. To allow the sliding of the bar 76, the bar 72 is provided at its ends with channel guides 78 for the bar 76.

The free edge of the partition, or rather the free edge of the slidable bar 76, facing the wall formed by the two panels 52, is provided with magnets 80 (FIGS. 5 to 7). The edges of the two panels 52 which meet are provided in the vicinity of the two magnets 80 with engaging plates 82 (or vice versa). The magnetic closures formed in this way are designed, when the closure 56 is open, to keep one of the panels 52 closed while the other panel 52 is open. When one of the sections contains documents and the other personal effects, this is designed to display only the documents in one section and not the contents of the other section.

With reference to FIG. 8, the piece of luggage of FIGS. 4 and following may be advantageously provided with a parallelepipedic box 86 on the external face of the base side of the frame 54. The dimensions of this box are preferably no greater than those of the case and the box normally acts as a support base for the case itself. The box 86 may be removed from the case as a result of fact that the lateral edges of the base side of the frame 54 have guides 88, for example L-shaped, in which there slide complementary longitudinal guides 90 of the box 86. The box 86 advantageously holds an umbrella, indicated by U, of the telescopic type.

With reference to FIGS. 9 and 10, a piece of luggage as shown in FIGS. 4 and following may have a further advantageous feature. The curved handle 58 if provided at both ends with extensions 92 in the form of straps or similar strip-like components. These components 92 extend to the rear of the upper side of the frame 54 passing through slots 94. Each of these is anchored to a traction spring 96 which recalls the handle 58 into a position in which it can be used as an actual handle (FIG. 9). The ends of the strip-like components 92 have a thicker portion 98 which may be hooked, in a manner which is not shown, to a stop 100 borne by the inner face of the upper side of the frame 54 towards its ends.

If the thicker portion 98 is unhooked from the stop 100, it is possible to extract the handle 58, as shown in FIG. 10, to use it, by means of its extensions 92, as a shoulder strap. In these circumstances, the complete extraction of the handle 58 and its extensions is prevented by the abutment of the thicker portions 98 against further stops 102 adjacent to the slots 94.

The materials which may be used for the structure and the covering of the piece of luggage of FIGS. 4 and following are the same as those listed for the piece of luggage of FIGS. 1 to 3.

I claim:

1. A parallelepiped luggage case, comprising:

a rigid quadrangular frame having an upper side with means for carrying said case, end sides and a base side;

first and second lateral walls lying in opposed parallel planes, at least one of said first and second lateral walls having a single walled frame perpendicular thereto along its perimetral edge, said single walled frame being telescopically slidable with respect to said quadrangular frame to allow the displacement of said lateral wall in a direction perpendicular to its plane between a retracted position in which it is located adjacent the quadrangular frame and a projecting position in which it is located spaced away from the quadrangular frame, for increasing the internal volume of said case;

a spring means being compressed between the lateral wall and the quadrangular frame for engaging said lateral wall and urging it towards the projected position with respect to the frame;

means formed in the quadrangular frame for guiding said single walled frame between extreme positions; and means coupled to the single walled frame for retaining the lateral wall in the retracted position against the compression of the spring means including a cursor having at least one latch, said cursor being slidable between first and second positions in a plane parallel with the base side and a coil spring engaging the cursor for urging it to the first position.

2. The case of claim 1 wherein said rigid quadrangular frame is comprised of first and second half-frames hingedly connected along a medium plane of said frame parallel to said first and second lateral walls.

3. The case of claim 2 wherein said first and second half-frames are comprised of an inner wall and an outer wall defining a slot therebetween.

4. The case of claim 3 wherein the single walled frame of at least one of said first and second lateral walls is telescopically slidable within the slot defined by the inner and outer walls of said first and second half-frame.

5. The case of claim 1 including a flat parallelepiped box located within said case and being fixedly attached to said base side, said box containing said spring means and said means for retaining the position of said lateral walls.

6. The case of claim 1 wherein a first lateral wall is divided into two panels hingedly connected to corresponding edges of the end sides of the frame so that both panels may be opened as the doors of a cupboard.

7. The case of claim 6 wherein a partition divides the internal volume of the case at a point where said panels meet.

8. The case of claim 7 further comprising means for retracting said partition against the second lateral wall.

9. The case of claim 7 wherein said partition is adapted with at least one magnetic closure means for securing said panels of said first lateral wall.

10. The case of claim 7 further comprising support means for said case, said support means including a parallelepiped container including means for removably securing said container to the base side of said case, said container for carrying accessories.

11. The case of claim 10 wherein said means for removably securing the container to the box comprises complimentary guides attached to the box for slidably engaging the container.

12. The case of claim 1 wherein said means for carrying further comprises means for retracting and extending said means for carrying.

13. The case of claim 1 wherein the means for retaining includes an operating tongue for the cursor.

14. The case of claim 1 wherein said means coupled to the single walled frame for retaining the lateral wall in the retracted position further includes block means attached to the single walled frame extending through the guide means and engaging the spring means and the operating latch of said cursor.

15. The case of claim 14 wherein the guide means is a slit in the quadrangular frame and the block means is a pin attached to the quadrangular frame passing through the slit and engaging the spring means against its compression.

16. The case of claim 15 wherein the means for retaining the lateral wall retracted further includes means for retaining the lateral wall projected including the slidable cursor having the latch means engaging the block means for locking the blocks in position either when the lateral wall is extended or when it is projected.

17. The case of claim 16 wherein the latch means of the slidable cursor is spring biased and has formed lugs engaging the block means locking them in position and hand operated means for moving the cursor against the bias of the spring to unlock the block means.

18. The case of claim 17 wherein the lugs extend in a direction of the bias of the spring and one lug extends from a free end of the cursor and a second lug is formed in an aperture in the cursor.

19. The case of claim 1 wherein said spring means comprises a mustache spring having lateral free ends engaging the means for retaining the lateral wall in the retracted position, and a coil intermediate the free ends.

20. A parallelepiped luggage case, comprising:

a rigid quadrangular frame having an upper side with means for carrying said case attached to the upper side, end sides and a base side;

first and second lateral walls lying in opposed parallel planes, at least one of said first and second lateral walls having a single walled frame attached thereto along its perimetral edge, said first lateral wall being divided into two panels hingedly connected to the corresponding edges of the two end sides of said quadrangular frame, means for opening said panels in the same way as the doors of a cupboard;

said single walled frame being telescopically slidable with respect to said quadrangular frame to allow the displacement of said lateral wall attached thereto in a direction perpendicular to its plane, between a retracted position in which it is located adjacent the quadrangular frame and a projecting position spaced from the quadrangular frame, as a result of which the internal volume is increased; and a partition formed by first and second bars, said first bar has a height corresponding to the spacing between said first and second lateral walls when said second lateral wall is retracted, said partition being hinged to said second lateral wall and provided with guide means extending vertically, said second bar being slidable in the guide means between a lowered position in the space of the hinged bar and a raised position in which it occupies the space between the hinged bar and the first lateral wall, when the second lateral wall is located in the projected position.

21. A parallelepiped luggage case, comprising:

a rigid quadrangular frame having an upper side with means for carrying said case, end sides and a base side and further comprising first and second half-frames hingedly connected along a medium plane of said frame and wherein each of said first and second half-frames is formed of an inner wall and an outer wall defining a slot therebetween;

first and second lateral walls lying in opposed planes parallel to the medium plane, at least one of said first and second lateral walls having a single walled frame perpendicular thereto along its perimetral edge, said single walled frame being telescopically slidable with respect to said quadrangular frame to allow the displacement of said lateral wall in a direction perpendicular to its plane between a retracted position in which it is located adjacent the quadrangular frame and a projecting position in which it is located spaced away from the quadrangular frame, for increasing the internal volume of said case, a spring means being compressed between the lateral wall and the quadrangular frame for engaging said lateral wall and urging it towards the projected position with respect to the frame;

means formed in the quadrangular frame for guiding said single walled frame between extreme positions; and means coupled to the single walled frame for retaining the lateral wall in the retracted position against the compression of the spring means.

22. The case of claim 21 wherein the means for retaining the position of said lateral walls comprises a cursor having at least one latch, said cursor being slidable between first and second positions in a plane parallel with the base side and a coil spring engaging the cursor for urging it to the first position.

23. The case of claim 22 wherein the means for retaining includes an operating tongue for the cursor.

24. The case of claim 23 wherein said means coupled to the single walled frame for retaining the lateral wall in the retracted position further includes block means attached to the single walled frame extending through the guide means and engaging the spring means and the operating latch of the cursor.

25. The case of claim 24 wherein the guide means is a slit in the quadrangular frame and the block means is a pin attached to the quadrangular frame passing through the slit and engaging the spring means against its compression.

26. The case of claim 25 wherein the means for retaining the lateral wall retracted further includes means for retaining the lateral wall projected including the slidable cursor having the latch means engaging the block means for locking the blocks in position either when the lateral wall is extended or when it is projected.

27. The case of claim 26 wherein the latch means of the slidable cursor is spring biased and has formed lugs engaging the block means locking them in position and hand operated means for moving the cursor against the bias of the spring to unlock the block means.

28. The case of claim 27 wherein the lugs extend in a direction of the bias of the spring and one lug extends from a free end of the cursor and a second lug is formed in an aperture in the cursor.

29. The case of claim 21 wherein said spring means comprises a mustache spring having lateral free ends engaging the means for retaining the lateral wall in the retracted position, and a coil intermediate the free ends.

30. The case of claim 21 wherein said single walled frame is telescopically slidable within one of said slots.

* * * * *